US007168273B2

(12) United States Patent
Neergaard et al.

(10) Patent No.: US 7,168,273 B2
(45) Date of Patent: Jan. 30, 2007

(54) SELECTIVE DISPENSING APPARATUS

(75) Inventors: Arthur Hampton Neergaard, Cincinnati, OH (US); Yousef Georges Aouad, Cincinnati, OH (US); Christopher Lawrence Smith, Liberty Township, OH (US); Lawrence Joseph Kelly, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 536 days.

(21) Appl. No.: 10/289,936

(22) Filed: Nov. 7, 2002

(65) Prior Publication Data

US 2004/0088796 A1 May 13, 2004

(51) Int. Cl.
*D06F 39/02* (2006.01)

(52) U.S. Cl. ..... 68/17 R; 68/207; 68/12.18

(58) Field of Classification Search ..... 68/17 R, 68/207, 12.02, 12.18; 134/113, 94.1, 95.1
See application file for complete search history.

(56) References Cited

U.S. PATENT DOCUMENTS 2,410,873 A * 11/1946 Gayring ..... 222/652
2,982,319 A * 5/1961 Magnuson ..... 141/160
2,989,994 A * 6/1961 Morris ..... 141/82
3,166,096 A * 1/1965 Lang ..... 137/564.5
3,207,373 A * 9/1965 Dannenmann ..... 222/651
3,239,385 A * 3/1966 Meyers ..... 429/115
3,901,253 A * 8/1975 Collins et al. ..... 134/57 R
3,988,908 A 11/1976 Beare et al.
4,026,131 A 5/1977 Dugger et al.
4,186,573 A 2/1980 Brenner et al.
4,260,054 A 4/1981 Bory et al.
4,265,372 A 5/1981 Wainberg
4,379,515 A 4/1983 Towsend
4,416,791 A 11/1983 Haq
4,429,812 A 2/1984 Steiner et al.
4,516,696 A * 5/1985 Eknor ..... 222/181.2
4,588,080 A 5/1986 Ginn
4,700,857 A 10/1987 Kittscher et al.
4,882,917 A 11/1989 Mizusawa et al.

(Continued)

FOREIGN PATENT DOCUMENTS

CA 1133712 10/1982

(Continued)

*Primary Examiner*—Frankie L. Stinson
(74) *Attorney, Agent, or Firm*—Julia A. Glazer; Kim William Zerby

(57) ABSTRACT

A dispensing apparatus for use with a replaceable unit dose package has at least one cavity sealed by a membrane, wherein the cavity contains additive materials to be dispensed. The dispensing apparatus is configured for use, for example, in a washing machine, wherein the washing machine has a plurality of cycles. The dispensing apparatus comprises a dispensing director having a dispensing signal generator and a monitor for distinguishing among a plurality of washing machine operating cycles. The dispensing apparatus further includes an actuator in communication with said dispensing director and configured to selectively electromechanically open the membrane in response to a dispensing signal, thereby releasing additive materials from said at least one cavity. Also disclosed is a disposable unit dose package for use in a washing machine and with a dispensing apparatus having a dispensing director and an electromechanical actuator in communication with said dispensing director. Still further disclosed is a kit, system, and method of dispensing laundry additive materials into a rotating washing machine having a drum.

5 Claims, 5 Drawing Sheets

U.S. PATENT DOCUMENTS

| | | | | | |
|---|---|---|---|---|---|
| 4,982,467 | A | | 1/1991 | Mizusawa et al. | |
| 5,033,643 | A | | 7/1991 | Schumacher | |
| 5,061,807 | A | | 10/1991 | Gethöffer et al. | |
| 5,129,120 | A | | 7/1992 | Cornette et al. | |
| 5,133,487 | A | | 7/1992 | Russi | |
| 5,176,297 | A | * | 1/1993 | Mooney et al. | 222/325 |
| 5,396,914 | A | * | 3/1995 | McNair | 134/57 D |
| 5,536,421 | A | | 7/1996 | Hartman et al. | |
| 5,687,588 | A | | 11/1997 | Azzani et al. | |
| 5,732,853 | A | | 3/1998 | Ganzeboom et al. | |
| 5,792,219 | A | | 8/1998 | Hartman et al. | |
| 5,823,016 | A | * | 10/1998 | Glotz | 68/3 SS |
| 5,950,458 | A | * | 9/1999 | Meyer et al. | 68/13 R |
| 6,138,693 | A | | 10/2000 | Matz | |
| 6,179,167 | B1 | | 1/2001 | Boot et al. | |
| 6,203,535 | B1 | | 3/2001 | Barney et al. | |
| 6,220,267 | B1 | * | 4/2001 | Joshi | 137/9 |
| 6,281,183 | B1 | | 8/2001 | Harbour | |
| 6,352,158 | B1 | | 3/2002 | Cole-Bennett et al. | |
| 6,378,274 | B1 | | 4/2002 | Harbour | |
| 6,439,387 | B1 | | 8/2002 | Bergman | |
| 6,571,993 | B2 | * | 6/2003 | Rodd et al. | 222/444 |
| 2001/0049846 | A1 | | 12/2001 | Guzzi et al. | |
| 2002/0049846 | A1 | | 4/2002 | Guzzi et al. | |
| 2002/0078589 | A1 | | 6/2002 | Hagemann et al. | |
| 2002/0088502 | A1 | | 7/2002 | Van Rompuy et al. | |
| 2002/0100773 | A1 | | 8/2002 | Rodd et al. | |
| 2002/0108969 | A1 | | 8/2002 | Rodd et al. | |
| 2003/0172960 | A1 | | 9/2003 | Aouad et al. | |
| 2003/0172961 | A1 | | 9/2003 | Aouad et al. | |
| 2003/0182732 | A1 | | 10/2003 | Davenet et al. | |
| 2003/0227394 | A1 | * | 12/2003 | Rothgeb et al. | 340/870.01 |

FOREIGN PATENT DOCUMENTS

| | | | | |
|---|---|---|---|---|
| DE | 39 03 636 | | * | 8/1990 |
| DE | 39 22 342 | A1 | | 1/1991 |
| DE | 39 34 123 | A1 | | 4/1991 |
| DE | 101 14 256 | A1 | | 3/2001 |
| DE | 19945849 | A1 | | 3/2001 |
| EP | 0 215 366 | | | 9/1986 |
| EP | 0 215 366 | B1 | | 10/1988 |
| EP | 0 351 671 | | | 7/1989 |
| EP | 1 195 350 | | | 4/2002 |
| FR | 2 486 794 | | * | 1/1982 |
| GB | 2 214 524 | | * | 9/1989 |
| GB | 2 288 191 | | * | 10/1995 |
| WO | WO 94/07979 | | | 4/1994 |
| WO | WO 96/26312 | | | 8/1996 |
| WO | WO 97/09480 | | | 3/1997 |
| WO | WO 00/02982 | | | 1/2000 |
| WO | WO 00/02987 | | | 1/2000 |
| WO | WO 00/29537 | | | 5/2000 |
| WO | WO 00/49218 | | | 8/2000 |
| WO | WO 01/07702 | A1 | | 2/2001 |
| WO | WO 01/07703 | A1 | | 2/2001 |
| WO | WO 01/07704 | A1 | | 2/2001 |
| WO | WO 01/16271 | | | 3/2001 |
| WO | WO 01/23295 | A2 | | 4/2001 |
| WO | WO 01/25526 | A1 | | 4/2001 |
| WO | WO 01/25527 | A1 | | 4/2001 |
| WO | WO 02/29150 | | * | 4/2002 |
| WO | WO 03/069042 | | | 8/2003 |
| WO | WO 03/069043 | | | 8/2003 |
| WO | WO 2004/044303 | A1 | | 5/2004 |
| ZA | 9800086 | | * | 1/1998 |

* cited by examiner

SELECTIVE DISPENSING APPARATUS

TECHNICAL FIELD

The present invention relates to apparatuses, systems, kits, and methods for conveniently and selectively dispensing laundry additive materials from a unit dose package into the drum of a washing machine during a predetermined cycle of the washing machine's operation. More particularly, an electromechanical dispensing apparatus is associated with a unit dose package and is placed into the drum of a washing machine to dispense laundry additive materials from the unit dose package during one or more predetermined cycles of the washing machine's operation.

BACKGROUND OF THE INVENTION

Consumers have come to expect continually improved performance from washing machines, specifically as characterized by increased speed, simplicity, energy efficiency, and cleaning effectiveness. One aspect of this improved performance requires the convenient dispensation of the proper laundry additive materials into the washing machine in precise quantities and at the correct times during the operation of the washing machine. In a conventional washing process, a consumer manually measures and introduces laundry additive materials into the drum of a washing machine prior to starting the washing machine. This manual introduction of laundry additive materials is time-consuming, messy, inaccurate and often requires laundry additive materials to be added at inopportune times.

In addition to the central liquid dispenser integral the drum of some laundry washing machines, certain other devices have been disclosed for effecting the automatic dispensation of laundry additive materials into the drum of a laundry washing machine. For example, PCT WO 01/25526 A1 discloses a portable, self-contained "smart dosing device" comprising a housing with a compartment that is closed by a cover. In response to a measured condition such as acceleration, the smart dosing device can, at an appropriate time, dispense laundry additive materials from the compartment into the drum of a laundry washing machine.

However, Applicants perceive a need in the art for a further improved method and device for automatically dispensing laundry additive materials into the drum of a laundry washing machine. More particularly, such improvements include the substantial elimination of selection, premeasuring and handling of laundry additive materials by a consumer, thereby reducing an operator's preparation time and increasing the effectiveness of the dispensation. Accordingly, a selective dispensing apparatus that can associate a disposable unit dose package is desirable. More particularly, there is a need in the art for a single apparatus configured to conveniently, precisely, automatically and selectively open the membrane of a unit dose package in order to dispense one or more laundry additive materials at the proper time(s) and during the proper cycle(s) of the automatic washing machine.

SUMMARY OF THE INVENTION

It is an object of the present invention to provide apparatuses, systems, kits and methods for selectively and independently dispensing one or more laundry additive materials during predetermined times or cycles in the operation of a laundry washing machine.

It is another object to provide apparatuses, systems, kits and methods to dispense laundry additive materials from a unit dose package into the drum of a laundry washing machine by an electromechanical dispensing apparatus attached to the unit dose package.

Additional objects, advantages, and novel features of the invention will be set forth in part in the description that follows, and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention defined herein, apparatuses, systems, kits and methods are provided for enabling a dispensing apparatus for use with a replaceable unit dose package having at least one cavity sealed by a membrane, wherein the at least one cavity contains additive materials to be dispensed. The dispensing apparatus is configured for use in a machine, wherein the machine has a plurality of cycles. The dispensing apparatus comprises a dispensing director comprising a dispensing signal generator and a monitor for distinguishing among a plurality of machine operating cycles. The dispensing apparatus further comprises an actuator in communication with said dispensing director and configured to electromechanically open the membrane in response to a dispensing signal, thereby releasing additive materials from said at least one cavity.

In accordance with another aspect of the present invention, a disposable unit dose package is disclosed for use in a washing machine and with a dispensing apparatus having a dispensing director and an electromechanical actuator in communication with said dispensing director. The disposable unit dose package comprises a tray configured to readily interface with the dispensing apparatus, wherein the tray comprises at least one cavity containing laundry additive materials. The disposable unit dose package further comprises a membrane configured to seal at least a portion of said at least one cavity and to remain closed until opened by said actuator.

In accordance with yet a further aspect of the present invention, a method is disclosed for dispensing laundry additive materials into a washing machine having a drum and a plurality of operation cycles. This method comprises inserting a unit dose package into a dispensing apparatus, wherein the unit dose package comprises a membrane and a tray containing laundry additive materials. The dispensing apparatus is placed into the drum along with articles of laundry to be washed, and the washing machine is operated such that the dispensing apparatus and the articles of laundry are rotated together within the drum. A sensor within the dispensing apparatus detects parameters of the washing machine's operation, wherein the parameters are used to determine the occurrence of one or more particular operation cycles. Upon occurrence of a predetermined operation cycle of the laundry washing machine, the dispensing director selectively opens the membrane.

In accordance with still a further aspect of the present invention, a kit is disclosed for dispensing laundry additive materials into a washing machine having a drum and a plurality of operation cycles. The kit comprises a disposable unit dose package including a tray having at least one cavity containing laundry additive material. The unit dose package further comprises a membrane configured to seal at least a portion of said cavity. The kit also includes a dispensing apparatus configured for selective association with said disposable unit dose package, wherein said dispensing apparatus comprises a dispensing director and an actuator. The dispensing director comprises a dispensing signal generator and a monitor for distinguishing among a plurality of machine operating cycles. Said actuator is in communication with said dispensing director and is configured to electromechanically open the membrane in response to a dispensing signal, thereby releasing additive material(s) from said at least one cavity.

In accordance with another aspect of the present invention, a system is disclosed for providing laundry additive materials to the wash liquor during a predetermined cycle of a fabric laundering operation in a drum-containing automatic laundering machine having a plurality of operation cycles. The system comprises a disposable unit dose package containing at least one laundry additive material. Also included is a dispensing apparatus configured for selective association with said unit dose package and for placement within said drum at the beginning of the laundering operation. An actuator associated with said dispensing apparatus is configured to electromechanically release said laundry additive material from said unit dose package in response to a dispensing signal communicated from a dispensing director associated with said dispensing apparatus. The dispensing director is configured to monitor operation cycles of the machine and to identify predetermined cycle(s).

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE EXEMPLARY EMBODIMENTS

Figure 1:
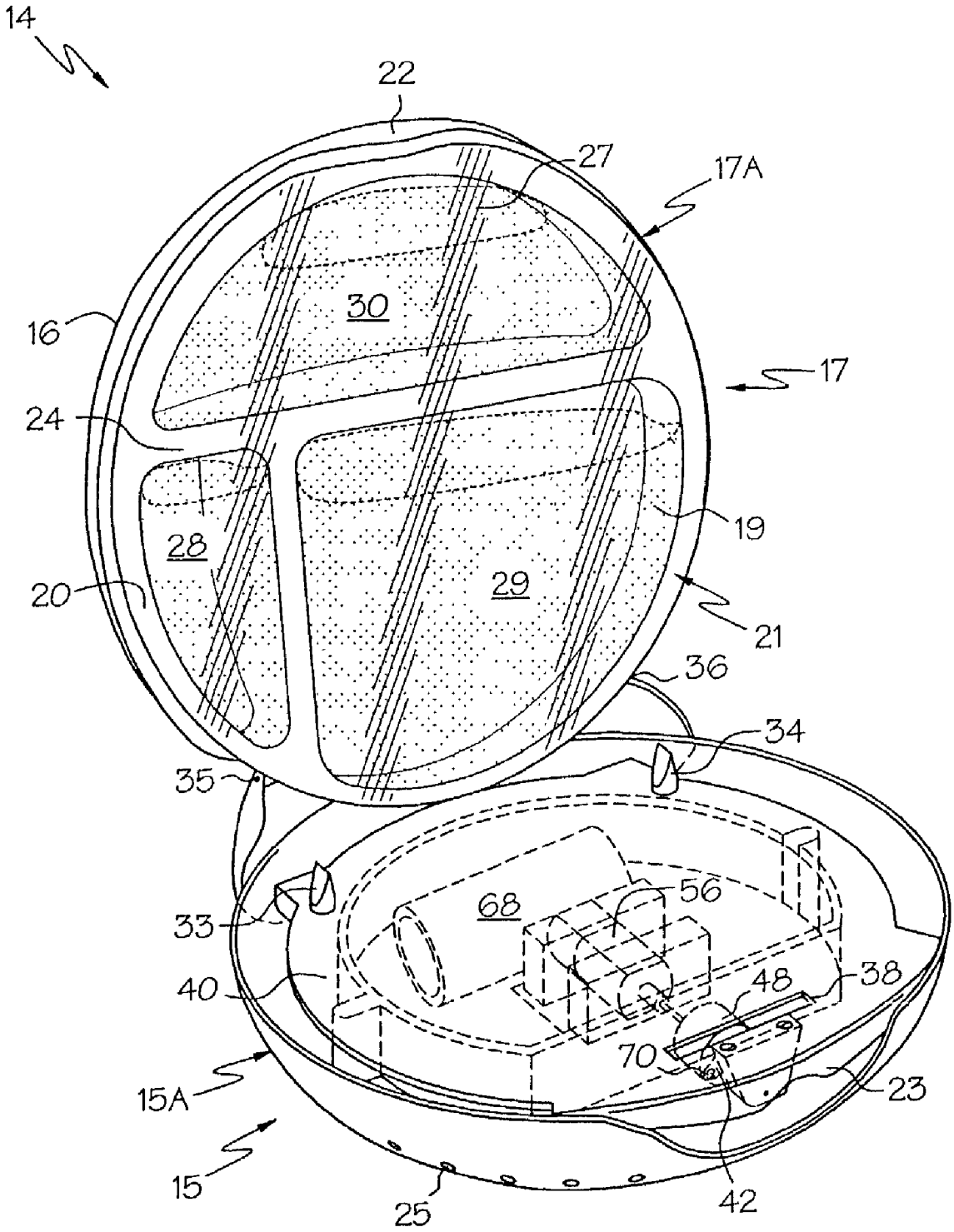
FIG. 1 is a front perspective view depicting a dispensing apparatus in accordance with one embodiment of the present invention.

The present invention and its operation is hereinafter described in detail in connection with the views of FIGS. 1–5 and the flowchart of FIG. 6, wherein like numbers indicate the same or corresponding elements throughout the views. Turning to FIG. 1, an embodiment of a dispensing apparatus 14 constructed in accordance with the principles of the present invention is shown. The dispensing apparatus 14 can be suitable for insertion into a laundry washing machine having a horizontally or vertically oriented drum, and may be further configured to facilitate dispensation of one or more laundry additive materials into the laundry fluid mixture within the drum (also known as "wash liquor") at a predetermined time during a predetermined operation cycle of the laundry washing machine.

For purposes of this invention, "laundry additive materials" can comprise any solid, liquid or gel materials, including but not limited to powders suspended in a liquid, which are conventionally added to the drum of a laundry washing machine along with the fabrics being laundered in order to effectively carry out the desired laundering procedure. Thus, a non-comprehensive list of suitable laundry additive materials would include, but is not limited to, detersive surfactants, detergent builders, bleaches, enzymes, bleach and enzyme stabilizers, bleach and enzyme activators, aqueous and non-aqueous solvents, pH adjustment and control agents, dispersants, anti-redeposition agents, dye transfer inhibitors, preservatives, anti-microbial agents, soil release agents, anti-wrinkle agents, fabric softeners and conditioners, chelating agents, suds suppressors, suds boosters, optical brighteners, perfumes, pro-perfumes, dyes, carriers, and combinations thereof. In use, dispensing apparatus 14 may be placed freely within the drum, attached mechanically to the drum (e.g., with a hook), or be permanently incorporated into the drum.

In an exemplary embodiment of the present invention, dispensing apparatus 14 can be placed freely (e.g., unattached) within the drum of a washing machine along with articles of clothing to be laundered, or may alternately be configured for mounting or other attachment to the drum. A dispensing apparatus in accordance with the present invention can assume a variety of specific mechanical configurations. In the embodiment of FIG. 1, dispensing apparatus 14 is illustrated as comprising a lower shell 15 containing electromechanical components configured to release one or more laundry additive materials from a unit dose package 21. Unit dose package 21 includes a tray 19 covered by at least one membrane 27. Formed within tray 19 may be a first cavity 28 for containing one or more laundry additive materials to be dispensed into the drum. Membrane 27 covers the open surface of first cavity 28, such as by adhesive attachment, plastic welding, or by connectors so as to prevent premature dispensation of laundry additive materials from first cavity 28. Membrane 27 would then be supported by tray 19 with sufficient tautness such that membrane 27 may be effectively opened by an actuator.

Other exemplary embodiments of the present invention might involve a tray having up to about ten additional cavities, such as illustrated by a second cavity 29 and/or a third cavity 30, wherein each additional cavity can be covered by either membrane 27 or other membranes. Multiple cavities within the same tray might be advantageously separated by one or more divider column 24 formed in tray 19. Divider column 24 as illustrated prevents laundry additive materials within one cavity from inadvertently entering another cavity and further provides additional tautness to membrane 27. Any cavity within tray 19 may or may not contain laundry additive material(s), and any laundry additive materials contained within a cavity may or may not be the same as the laundry additive materials of another cavity.

Tray 19 can be formed from any formable plastic, paper, metal, film, or other material, laminate, or combination thereof, capable of maintaining its structural integrity and not adversely reacting when subjected to laundry additive materials and the relatively harsh environment present within the drum. In an exemplary embodiment, tray 19 may be formed from a thermoplastic or thermoset plastic. A thermoplastic tray 19 can be manufactured by a conventional plastic injection molding or thermoforming process, for example.

The membranes of the present invention (e.g., membrane 27) can be provided in the form of any paper, plastic film, metal foil, composite thereof, laminate or combination thereof, or other material(s) capable of withstanding and not reacting to laundry additive materials and the relatively harsh environment within the drum. In an exemplary embodiment of the present invention, a membrane 27 might be formed from polypropylene. Membrane 27 may also be configured to be selectively tom, peeled, cut, pierced, cracked or otherwise opened electromechanically when needed. Also, membrane 27 might be configured to exhibit a sufficiently low notch tear strength such that a knife, blade, or other electromechanically driven device can cut or puncture the same on demand to effectively open membrane 27. In certain embodiments, portions of the membrane 27 may be reduced in strength and/or thickness or may be sufficiently or effectively frangible to facilitate this opening. In other embodiments, portions of membrane 27 can be configured to dissolve or melt when exposed to certain fluids or temperatures within the drum, as, for example, would be characteristic of a membrane 27 formed from polyvinyl chloride. Inexpensive materials and methods of manufacture can be selected such that unit dose package 21 is configured to be disposable after a single use.

In one exemplary embodiment of the present invention, unit dose package 21 may be held against or closely adjacent to an opening surface 40 of lower shell 15 by grooves or other connectors present on lower shell 15, whereby unit dose package 21 can be physically supported by lower shell 15. However, if unit dose package 21 is comparable with or larger in size than lower shell 15, unit dose package 21 might be configured to physically support lower shell 15. In yet another embodiment, as depicted by FIG. 1, for example, an upper shell 17 may be configured to receive and retain unit dose package 21 by at least the rim 20 of unit dose package 21. When upper shell 17 and lower shell 15 are closed, rim 20 becomes snugly confined between upper shell 17 and lower shell 15 thereby securing membrane 27 adjacent to opening surface 40.

Figure 5:
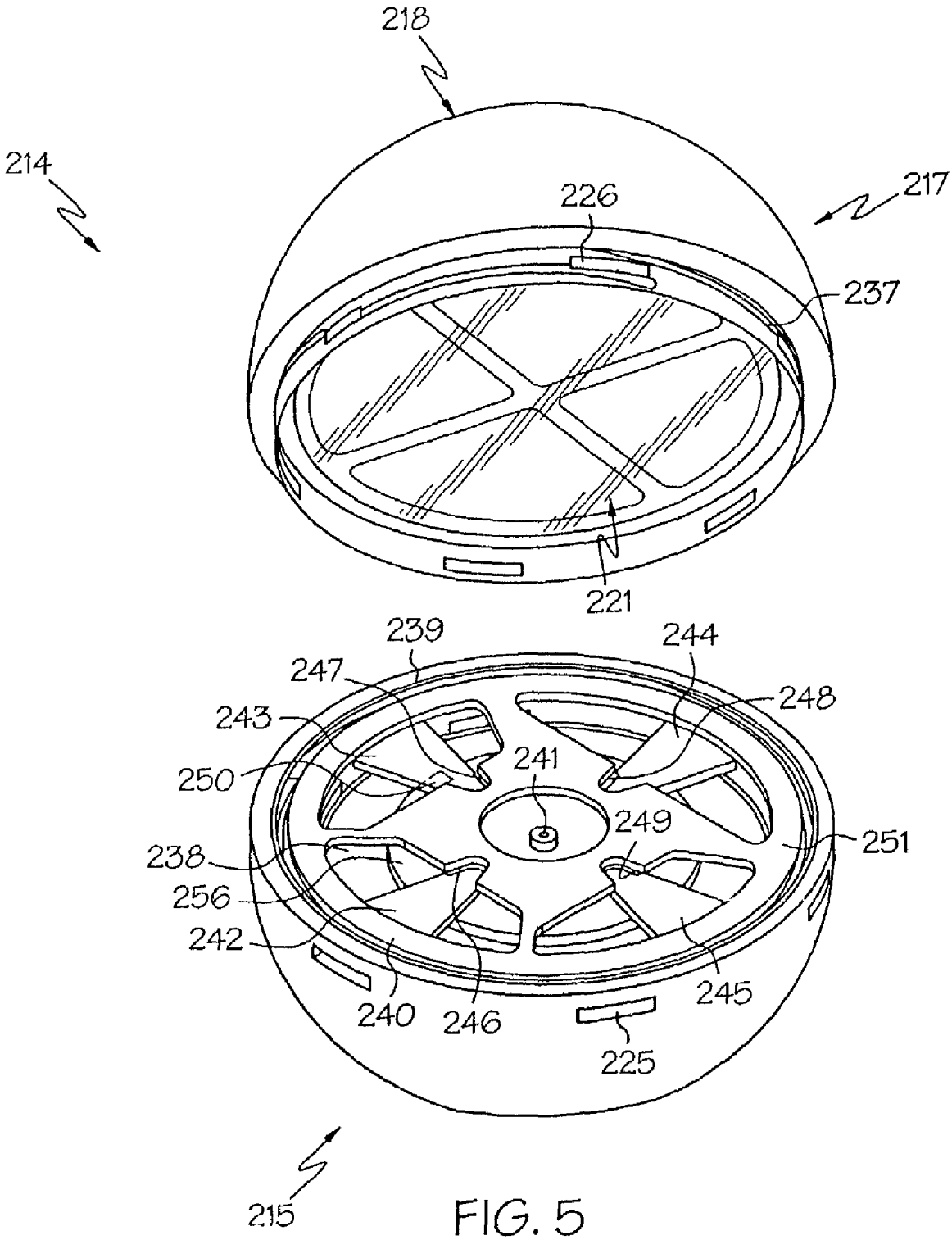
FIG. 5 is a front perspective view depicting yet another exemplary embodiment of a dispensing apparatus in accordance with the present invention.

In one exemplary embodiment of the present invention as shown in FIG. 1, for example, upper shell 17 can include an opening 16 that enables at least a portion (not shown) of the tray 19 to protrude through upper shell 17. Opening 16 may be partitioned with skeletal supports (not shown) that correspond with one or more divider column(s) 24 in unit dose package 21. Such skeletal supports can strengthen an upper shell having such an opening and can enable use of a unit dose package having diminished structural rigidity, as such skeletal supports can be configured to enable the upper shell to better support the unit dose package against the opening surface of the lower shell. In another embodiment as shown in FIG. 5, for example, upper shell 217 might be substantially enclosed by a dome-like top 218 so as to enclose substantially all portions of a unit dose package 221 within and/or between upper shell 217 and the lower shell 215. By enclosing the unit dose package 221, as shown in FIG. 5, for example, unit dose package 221 can be substantially protected from the rigors of physical contact with the drum and articles of laundry within the drum. Hence, with such protection, unit dose package 221 might be formed from thinner and/or less-expensive materials having reduced strength or durability. Although not shown, upper shell 217 having dome-like top 218 may further include one or more interior walls that project between the cavities of the tray and adjacent to one or more divider columns of unit dose package 221 when unit dose package 221 is inserted into upper shell 217. Such interior walls might help to maintain the membrane adjacent to the opening surface 240 and further ensure that unit dose package 221 is properly inserted into upper shell 217 by a consumer.

In the embodiment of FIG. 1, upper shell 17 fastens to lower shell 15 with a first hinge 35 and a second hinge 36. The hinges 35 and 36 enable upper shell 17 to pivot open with respect to lower shell 15 in order that unit dose package 21 can be inserted into upper shell 17. Upon insertion of unit dose package 21, upper shell 17 can be pivoted along hinges 35 and 36 to close against lower shell 15, thereby causing membrane 27 to abut opening surface 40. In this exemplary embodiment, a latch 22 on upper shell 17 engages a catch 23 on lower shell 15 to maintain upper shell 17 closed against lower shell 15. In other embodiments of the present invention, one or more hooks, clasps, screws, or other fastening devices maintain the engagement of lower shell 15 to upper shell 17, with or without the presence of hinges 35 and 36. In alternate embodiments, such as that shown in FIG. 5, lower shell 215 can be configured to snap or screw together with upper shell 217 without hinges or a catch, such as with male threads 237 disposed on upper shell 217 and female threads 239 disposed on lower shell 215. It should be understood that any arrangement for maintaining a unit dose package in close association with a lower shell and its opening surface may equally be employed.

Regardless of the specific configuration of a lower shell with respect to a unit dose package, the lower shell and the upper shell, if present, can be made of any material having sufficient strength and chemical resistance to withstand the temperatures, laundry additive materials and turbulence present within the drum of a laundry washing machine. Examples of suitable materials include polypropylene, polyester, polyethylene terephthalate (PETE), TEFLON, nylon, polyethylene, rubber, carbon fiber, aluminum, composites, and a variety of other materials. Although it is not necessary that both the lower shell and upper shell be formed from the same material, both the lower shell and upper shell can be formed from polypropylene or polyester. In an exemplary embodiment of the present invention, both the lower shell and upper shell can be formed from polypropylene.

In an embodiment such as shown in FIG. 1, lower shell 15 might be formed with an integral outer surface 15A formed of the same material as lower shell 15. Likewise, upper shell 17 might also be formed with an integral outer surface 17A formed of the same material as upper shell 17. However, in an alternate exemplary embodiment, not depicted in the drawings, outer surfaces 15A and 17A may be formed of materials different than those used to form lower shell 15 and upper shell 17, respectively. For example, outer surface 15A might comprise rubber even if lower shell 15 comprises polypropylene. A rubber outer surface 15A can be connected to a polypropylene lower shell 15 through a dual-molding process, adhesives, connectors, a combination thereof, or other suitable means. By having an outer surface formed from a different material than its corresponding shell, a dispensing apparatus can exhibit, for example, improved shock resistance, durability, and/or chemical resistance while having excellent strength, low weight and economic advantages.

Figure 4:
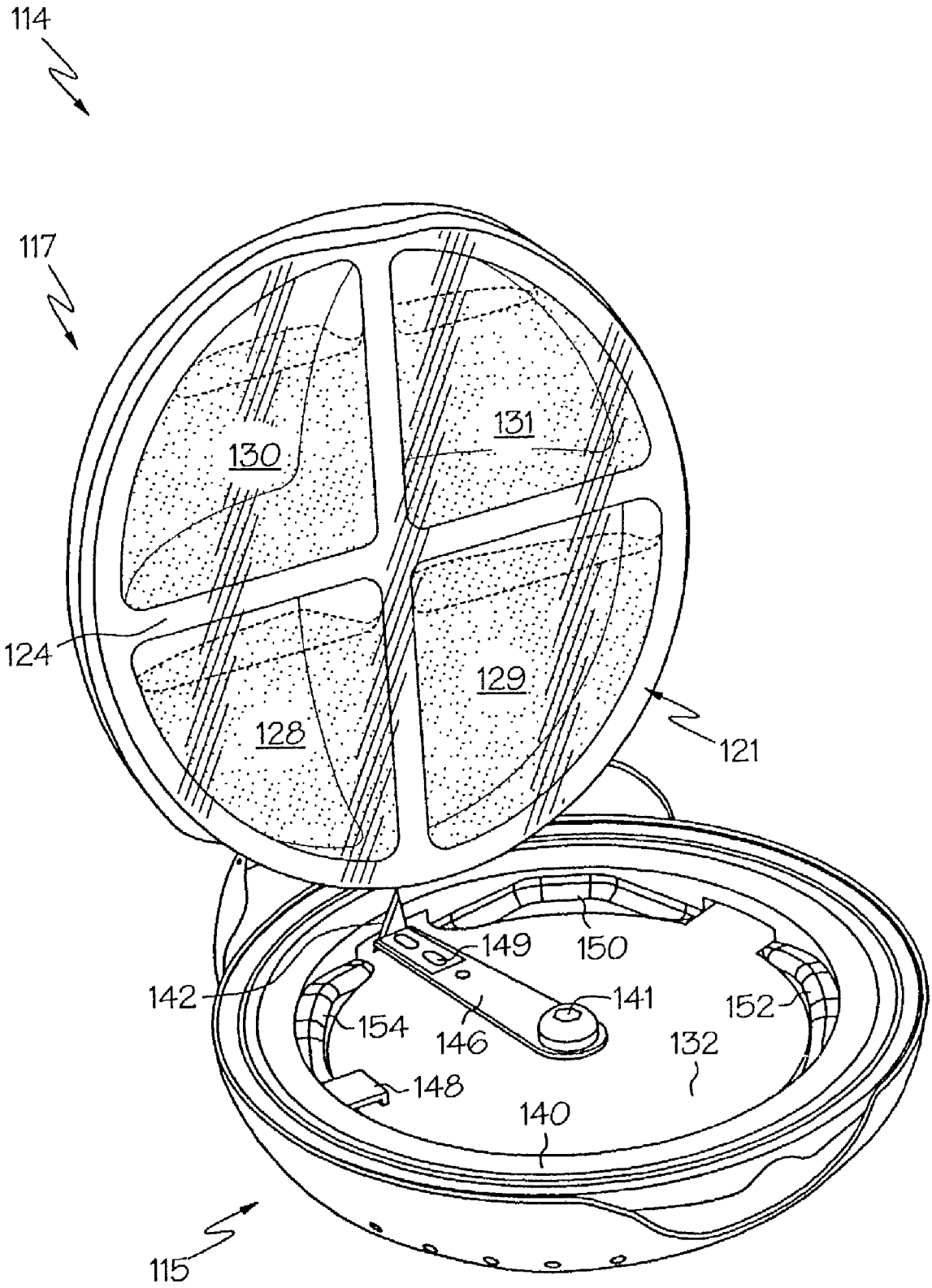
FIG. 4 is a front perspective view depicting another exemplary embodiment of a dispensing apparatus in accordance with the present invention.

Regardless of how a unit dose package is held in conjunction with a dispensing apparatus of the present invention, the combination of the unit dose package and the dispensing apparatus might have an effectively neutral buoyancy in use (e.g., buoyancy equivalent to that of the wash liquor) to prevent the combination from sinking to the bottom or floating to the top of the wash liquor. Furthermore, the combination might advantageously be sufficiently small such that it is easy to use and the laundering capacity of the drum is not significantly reduced thereby. For standard domestic laundry applications, the apparatus should be relatively compact, wherein one exemplary compact arrangement could involve a combination of a dispensing apparatus and a unit dose package having no dimension exceeding about five inches. Furthermore, the combination of the dispensing apparatus and the unit dose package may be sufficiently streamlined such that articles of clothing within the drum are not damaged thereby. In fact, appropriate design might actually allow the dispensing apparatus to arguably improve laundering efficacy by assisting in distribution and movement of the laundry within the wash liquor. In exemplary embodiments of the present invention, as depicted by FIGS. 1 and 4, for example, the combination of a dispensing apparatus and a unit dose package can be substantially disk-shaped. In another exemplary embodiment, as depicted by FIG. 5, for example, the combination might be substantially round, but with at least one flattened side to minimize or prevent rolling.

In use, it is generally desirable that opening surface 40 engages membrane 27. In the embodiment shown in FIG. 1, for example, one or more spikes 33–34 can be disposed upon opening surface 40 and configured to pierce one or more portions of membrane 27 upon closure of upper shell 17 with lower shell 15. This piercing can cause laundry additive materials from within one or more cavities to exit unit dose package 21, as would be desired for certain detergents, for example. These laundry additive materials can be swept by the wash liquor into the drum through one or more aperture(s) or vent(s) 25. In this manner, certain laundry additive materials that might normally react adversely if premixed in advance, such as some detergents and bleaches, can be simultaneously released despite their separate confinement within distinct cavities of tray 19. In certain embodiments, a unit dose package might interact with the dispensing apparatus so as to actuate or depress spikes 33–34 or other structure configured to effectively pierce, puncture or open at least a portion of unit dose package 21. For example, a dispensing apparatus might include a release mechanism configured to detect a notch in the unit dose package. If this notch is detected, the release mechanism can mechanically displace one or more of the spikes or other initial opening structure, thereby preventing the displaced spike(s) from opening the membrane of the unit dose package. However, if no notch is detected, the spikes will remain in position and will accordingly pierce the membrane of the unit dose package. Spikes 33–34 may not typically be well suited, however, to dispense fabric softeners because the release of fabric softeners into the drum is often preferably delayed until during the last rinse cycle. For this reason, a dispensing apparatus in accordance with the present invention might incorporate at least one selective actuator configured to effectuate the delayed release of one or more laundry additive materials, such as a fabric softener, at the proper subsequent time.

Figure 2:
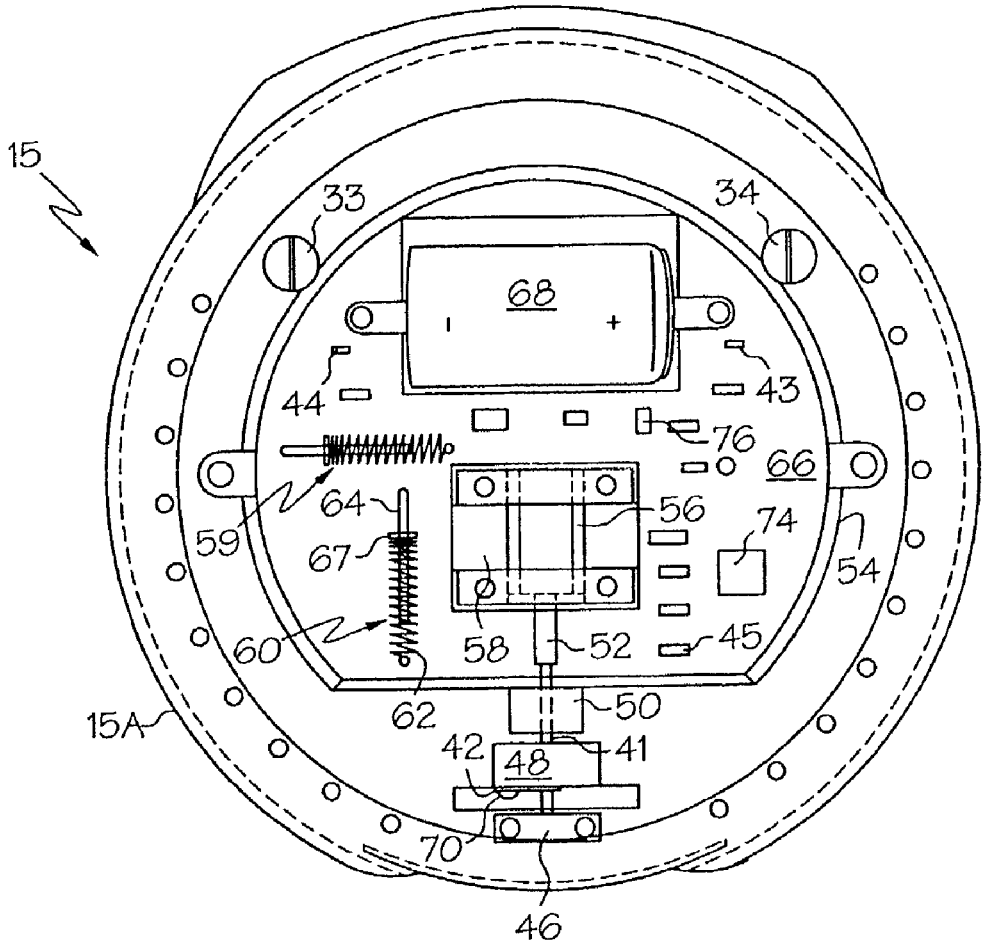
FIG. 2 is a schematic view depicting certain internal components of the dispensing apparatus of FIG. 1.

FIG. 2 depicts an exemplary configuration of certain components of a dispensing apparatus 14 such as seen in FIG. 1, and as might be disposed at least partially within lower shell 15. The components in this example include a circuit board 66, an actuator 56, a power supply 68, a first sensor 59, a second sensor 60, an amplifier 76, a dispensing director 74, one or more light-emitting diodes 43–45, and a mount 58 along with a plurality of other components as appropriate to accomplish the functions described herein. At least a portion of circuit board 66 and its attached components might be covered with silicone, epoxy or another composition suitable to seal out moisture and/or prevent vibratory damage. Circuit board 66 may additionally include electronic components capable of transmitting and receiving data transmission, such as to and from a laundry washing machine or a remote laundry washing machine. Examples of such data received by a dispensing apparatus might relate to particular cycle information, data input by a consumer and actual machine operating conditions (e.g., drum rotation speed for a washing machine application and other information measured by the laundry washing machine). Examples of data transmitted from a dispensing apparatus might include speeds, inertias, water temperature, and chemical concentrations present within the drum. In this manner, a dispensing apparatus can integrate its functionality with that of the particular application (e.g., in our examples, a laundry washing machine).

Power supply 68 provides power to components attached to circuit board 66. In various embodiments of the present invention, for example, a power supply 68 might include one or more batteries, capacitors, solar cells, inductive energy receivers, kinetic energy generators, fuel cells, or other such devices, or combinations thereof. Power supply 68 might comprise a lithium battery configured not to be recharged and not to be replaceable by a consumer. Alternatively, the power supply might comprise a rechargeable battery and/or a battery capable of removal from the lower shell for replacement through a door or other opening (not shown) in the lower shell. In one exemplary embodiment, the power supply might comprise a rechargeable battery that can be recharged without being removed from the lower shell, wherein power can be transmitted to the rechargeable battery from an external source through, for example, electrical contacts (not shown) disposed on the outer surface of the lower shell.

An exemplary dispensing apparatus for washing machine applications might include at least one sensor (59–60) configured to detect parameters from which dispensing director 74 can ascertain the current operational cycle of the laundry washing machine (e.g., by sensing spin cycles). For example, either or both sensors 59 and 60 may be configured to detect inertia to which dispensing apparatus 14 is exposed and, for example, can be designed to generate a signal upon experiencing an acceleration exceeding about ten times gravity. An example of such a sensor comprises a spring 62 disposed at least partially surrounding a post 64, such that adequate inertia causes the distal end 67 of spring 62 to deflect outwardly such that an interior surface of spring 62 contacts post 64, thereby forming an electrical connection. In order to ensure accurate operation and sensitivity of such a spring style sensor, the distal end 67 of the spring 62 may include more windings and/or more closely spaced windings to "weight" it for precise sensitivity.

A similar but alternate embodiment of an inertia sensor might include a spring having a distal end disposed at least partially within a larger conductive ring, such that the distal end of the spring deflects outwardly into contact with the ring as a result of inertia, thereby facilitating an electrical contact closure. Whenever a spring is employed as part of a sensor 59–60 for detecting inertia, the specific structure of the spring may be configured such that the spring will sufficiently deflect to establish the required electrical connection when a pre-selected inertia is encountered by the dispensing apparatus. Relevant aspects of the specific structure of the spring include but are not limited to the material forming the spring, the diameter of the wire forming the spring, the pitch of the wire forming the spring, and the number of windings concentrated at the distal end of the spring.

In an exemplary embodiment of the present invention, sensors 59–60 can be configured to detect inertia in all three axes. For example, inertia can be detected along all three axes when two of the aforementioned spring-type sensors are mounted to circuit board 66 substantially perpendicularly with respect to each other, as depicted in FIG. 2. In this manner, each sensor can detect inertia along two axes, wherein one measured axis of each sensor can also be measured by the other sensor. For example, a first sensor might be configured to detect inertia in both the x and z axes and a second sensor might be configured to detect inertia in both the y and z axes, whereby the sensors together thereby detect inertia in all three axes. Although each sensor might connect to a respective input of dispensing director 74, in an alternate exemplary embodiment, two or more sensors can be electrically connected in parallel into a single input of dispensing director 74.

Sensors 59–60 can also be configured to measure ambient characteristics other than the inertia to which a dispensing apparatus is exposed. For example, the sensors might be configured to detect changes in temperature, pressure, acceleration, frequency, acoustical noise, light, rotational velocity, and/or a plurality of other measurable characteristics or operations of a washing machine or other mechanism. A dispensing apparatus in accordance with the present invention can similarly have one or more sensors, wherein each sensor may or may not be configured to sense an ambient characteristic different than that sensed by another sensor.

In this example, dispensing director 74 might be configured to receive power from power supply 68 and to receive signals from sensors 59–60 corresponding to one or more sensed conditions or characteristics within the drum. Dispensing director 74 can include a monitor for distinguishing among cycles of the washing machine and might further contain a dispensing signal generator for controlling dispensation by actuator 56. An exemplary dispensing director can comprise one or more electrical components configured as memory, a counter, a timer, and a controller. As shown in the washing machine dispenser example of FIG. 2, dispensing director 74 might comprise a single electronic component, such as a central processing unit (e.g., a processor) or an application specific integrated circuit. Dispensing director 74 might also include an EEPROM, NV-RAM, RAM, or another data-storage device.

With such an arrangement, dispensing director 74 can process the signals received from sensors 59–60 and can communicate with actuator 56 in response to those sensor signals in order to cause operation of actuator 56. Although such communication between dispensing director 74 and actuator 56 may be continuous or substantially continuous, such communication might alternatively be periodic, sporadic, and/or only present during periods when actuator operation is desired. Operation of actuator 56 in response to signals from sensors 59–60 and/or dispensing director 56 can be immediate, or might involve a predetermined time delay, or might require another condition precedent (e.g., detection of one or more additional cycles by the sensors) to first be satisfied. Dispensing director 74 can operate actuator 56 in accordance with a program stored within dispensing director 74 for selecting the cycle during which the laundry additive materials will be released from unit dose package 21. Although the program may be installed into dispensing director 74 by the manufacturer of dispensing director 74, the program might alternatively be installed into dispensing director 74 by the manufacturer of dispensing apparatus 14. As yet another alternative, the program can be "learned" by dispensing director 74 by, for example, monitoring the sensors and recording characteristics of one or more operating cycles of a washing machine. Thus in subsequent wash cycles, dispensing director 74 can then compare the sensor signals with the characteristics stored in the "learned" program to identify the most effective time(s) to dispense laundry additive materials from the unit dose package.

In some embodiments, a consumer may also be given the opportunity to install and/or alter the program of dispensing director 74. If the consumer is given this ability, for example, the consumer might be permitted to adjust the time(s) at which the dispensing apparatus releases laundry additive materials into the drum. To facilitate these features, one or more switches or pushbuttons (not shown) may be disposed within lower shell 15 to accept a selection by a consumer. Alternately, an infrared or other data port may be provided in the lower shell for receiving or downloading programmed instructions from a computer, personal digital assistant, or other programming tool. In still another embodiment, dispensing director 74 might "learn" of a program, operational sequence or other dispensing information from an associated unit dose package. For example, a dispensing director could associate a bar code scanner for reading information (e.g., types, quantities, locations, and optimal release times of laundry additive materials) from a bar code label or other identifying indicia present on an associated unit dose package. As another example, one or more switches or other sensors can be associated with the dispensing director for detecting physical, magnetic, translucent and/or other detectable characteristics of an associated unit dose package, wherein such characteristics can be indicative of a suitable program or operational sequence for dispensing laundry additive materials from the unit dose package. For example, as mentioned above, the presence or absence of a notch in the unit dose package could be used to customize the dosing regime implemented by a dispensing director for a particular unit dose package.

One or more output signals from dispensing director 74 can be configured to control the operation of actuator 56, either directly or, for example, through an amplifier 76 such as a transistor, a relay, or an operational amplifier. Dispensing director 74 might also generate output signals to one or more light emitting diodes 43–45 to, for example, indicate to a consumer the present status of the battery, operation of the sensors, status of the counter and/or operation of the actuator. Audible feedback, including beeping noises and/or simulated speech, might also be generated by dispensing director 74 as feedback to a consumer.

In the washing machine application example, dispensing director 74 might advantageously be configured to identify the present operational state of the laundry washing machine by evaluating signals from sensors 59–60. In an exemplary embodiment, wherein sensors 59–60 comprise inertia-sensing switches, dispensing director 74 can identify the operational cycle of the laundry washing machine based on the timing and duration of signals generated by sensors 59–60. For example, a typical washing machine has a plurality of operational cycles, including at least one wash cycle, one spin cycle and one rinse cycle. During a wash cycle, the drum agitates and rotates at relatively low speeds, causing a dispensing apparatus (e.g., 14) present within the drum to be frequently bumped and shifted in position. It has been found that such bumps and shifts in a washing machine drum often subject the dispensing apparatus to accelerations nearing forty times gravity. Each substantial (e.g., exceeding ten times gravity) bump or shift of the dispensing apparatus causes one or both of the inertia-sensing sensors 59–60 to momentarily close. Hence, during a wash cycle, when the drum slowly rotates and agitates its contents, the dispensing apparatus bounces around within the drum and its sensors 59–60 resultantly generate a rapid succession of short pulses that can be received by dispensing director 74.

When the laundry washing machine enters a spin cycle, however, the drum rotates rapidly for an extended period thereby causing the dispensing apparatus to remain in a substantially constant or fixed location within the rotating drum. This rapid rotation generally subjects the dispensing apparatus to an extended radial acceleration sufficient to close sensors 59–60 (e.g., ten times gravity) essentially continuously until the rapid rotation of the drum ceases. Hence, during a spin cycle, sensors 59–60 effectively remain closed for a relatively long period of time, resulting in a substantially continuous signal to dispensing director 74. Accordingly, dispensing director 74 can determine whether the laundry washing machine is conducting a wash cycle or a spin cycle by evaluating the nature of the signal(s) received from sensors 59–60. In this example, dispensing director 74 can identify a wash cycle from a plurality of short pulses from one or more inertia sensors, and can identify a spin cycle from a relatively long (e.g., greater than about twenty seconds) and continuous pulse from such sensor(s). Because a rinse cycle can immediately follow a spin cycle, dispensing director 74 in this example can identify a rinse cycle by the completion of a detected spin cycle. In an application of the invention comprising temperature sensors, the dispensing director can also identify a rinse cycle by the relatively cooler temperature within the drum versus the higher temperatures present during warm or hot water wash cycles. In another embodiment, the sensors might comprise one or more microphones, and the dispensing director might distinguish a rinse cycle from a wash cycle by the distinctive noises associated with each cycle as detected by the microphone(s).

Figure 3:
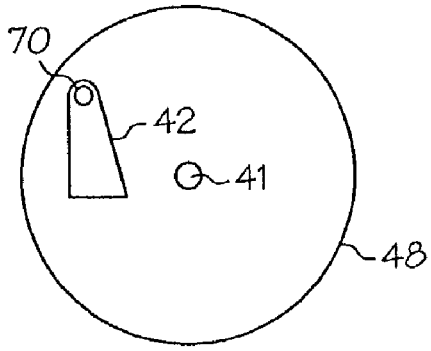
FIG. 3 is an enlarged view depicting details of exemplary mechanical components of the dispensing apparatus of FIG. 1.

In one illustrative embodiment as shown in FIGS. 1–3, opening surface 40 can comprise a blade opening 38 through which a blade 42 selectively projects into unit dose package 21. As best seen in FIG. 3, in this example blade 42 connects to flywheel 48 by a bolt 70 or other similar connecting device such that blade 42 can swivel freely around bolt 70 upon rotation of flywheel 48. As seen in FIG. 2, flywheel 48 can be driven by a shaft 41, wherein shaft 41 can be coupled to an actuator 56 (e.g., a motor) through a seal 50 and a spacer 52. Actuator 56 may be conveniently connected to circuit board 66 with a mount 58 or other connection arrangement. The distal end of shaft 41 (opposite actuator 56) is shown as being received in a shaft support 46. When flywheel 48 is rotated by the motor, centrifugal force can cause blade 42 to project outwardly from flywheel 48 through blade opening 38 and into membrane 27, thereby causing the laundry additive materials to be released from at least one cavity 19 of unit dose package 21. Although shaft 41, flywheel 48, blade 42, bolt 70, and shaft support 46 may be exposed to the wash liquor, seal 50 and the internal cavity wall 54 prevent the wash liquor from reaching circuit board 66, to which actuator 56, power supply 68 and all other electrical components can connect. In an exemplary embodiment, seal 50 might constitute an o-ring or other dynamic seal arrangement. Any components of the dispensing apparatus exposed to the wash liquor can be formed from one or more materials that will not be adversely affected by the laundry additive materials or by the relatively harsh environment present within the drum. Examples of such materials include stainless steel, composites and/or a variety of plastics. Hence, shaft 41, flywheel 48, blade 42, bolt 70, as well as any screws, hinges, latches, and/or other hardware of dispensing apparatus 14 that might be situated for possible communication with the wash liquor can similarly be formed from such resistant materials. Blade 42, for example, might be formed from ceramic, glass, silicon, quartz, aluminum, carbon fiber, or another suitably rigid material.

In another exemplary embodiment of the present invention, as depicted in FIG. 4, a dispensing apparatus 114 can comprise a lower shell 115 having an opening surface 140 and an upwardly disposed shaft 141 rotatably attached to a rotating member 146. Affixed adjacent to the end of rotating member 146 might be a knife 142 disposed upwardly and configured to pierce the membrane of unit dose package 121 in an upper shell 117 when shaft 141 rotates rotating member 146 over a first cam or incline 150. One or more additional inclines, such as a second incline 152, a third incline 154 and a fourth incline (not shown), may also be present upon opening surface 140 to cause vertical deflection upon rotation of shaft 141 of rotating member 146 and its knife edge against portions of the membrane of unit dose package 121. As shown in FIG. 4, for example, the unit dose package 121 can comprise a first cavity 128, a second cavity 129, a third cavity 130, and a fourth cavity 131, wherein each of the cavities can be separated by one or more divider columns (e.g., 124).

In one exemplary embodiment of the present invention, knife 142 may be fastened to rotating member 146 by means of a fastener 149, such as an adhesive, mechanical fastening means, rivet, plastic weld, or some other attachment means. Conversely, rotating member 146 and knife 142 can be integrally formed from the same material and/or manufactured as a single component from multiple materials. A tab or shield 148 may also be provided to effectively cover knife 142 under certain circumstances to thereby prevent inadvertent access to knife 142 and/or to prevent puncturing of the membrane at an inopportune time. In an exemplary embodiment, shaft 141 can pass through a seal (not shown) adjacent to plate 132. The seal can prevent wash liquor from reaching the circuit board (not shown) and the actuator (e.g., a motor) that drives shaft 141 (also not shown).

In yet another exemplary embodiment as depicted by FIG. 5, a dispensing apparatus 214 can include an opening surface 240 and can comprise upwardly deflecting arms 242–245 having upstanding sharp edges or ridges 246–249 (e.g., having a U-shape) configured to selectively release laundry additive materials from a unit dose package 221. More specifically, opening surface 240 can be configured adjacent to the membrane of unit dose package 221 when the upper shell 217 containing unit dose package 221 is closed against a lower shell 215. Opening surface 240 includes at least one window 238 through which a first arm 242 extends. In a more exemplary embodiment of the present invention, a plurality of arms, such as a second arm 243, a third arm 244, and a fourth arm 245 can be configured to selectively extend through respective windows in opening surface 240. Beneath arms 242–245 might be a rotary wheel 256 that can be rotatably coupled to a shaft 241.

Rotary wheel 256 can include a raised projection or cam surface 250 that can be configured to selectively cause one or more arms 242–245 to deflect as projection 250 passes beneath each of arms 242–245. Each arm 242–245 may be fitted with a ridge 246–249, respectively, configured to fracture, open, pierce or tear the membrane of unit dose package 221 when its corresponding arm 242–245 is deflected. In operation, shaft 241 can selectively rotate rotary wheel 256, causing projection 250 to deflect first arm 242 having first ridge 246 through window 238 and against and/or into the membrane of unit dose package 221, thereby releasing laundry additive materials from at least one cavity of the tray of the unit dose package 221 and, in this example, through vents 225 and 226 into the drum. In an exemplary embodiment, shaft 241 can pass through a seal (not shown) adjacent to rotary wheel 256. The seal can prevent wash liquor from reaching the circuit board (not shown) and the actuator (e.g., a motor) that drives shaft 241 (also not shown).

Other and different electromechanical arrangements can be incorporated within a dispensing apparatus of the present invention to selectively pierce, cut, tear, peel or otherwise open the membrane covering one or more cavities of a unit dose package as needed. For example, the dispensing apparatus might incorporate an actuator that comprises an electrically actuated piston configured to pierce or otherwise open the membrane. As another example, the actuator might comprise a heater or a laser configured to melt or bum an opening in the membrane of a unit dose package. In still further embodiments, a spring associated with a mechanical actuator can be compressed under human force. Upon compression, the spring can be locked into position by a low-power electromechanical actuator. When power is applied to the low-power electromechanical actuator in response to a signal from the dispensing director, the low-power electromechanical actuator releases the force stored in the spring, thus enabling a mechanical actuator to pierce or otherwise open the membrane. In still another example, the actuator could alternatively comprise a motor or mechanical arrangement operatively configured to peel a portion (e.g., a draw string or a zip string) of a membrane, thereby enabling laundry additive materials to be dispensed from a unit dose package. Essentially unlimited additional configurations of actuator(s) are available for incorporation within the present invention to facilitate the opening of the membrane, as can be understood by those skilled in the art. It should also be understood that a dispensing apparatus may include a plurality of actuators wherein each respective actuator can be configured to open a specific portion of the membrane corresponding to one or more cavities within the tray upon actuation by the dispensing director.

Figure 6:
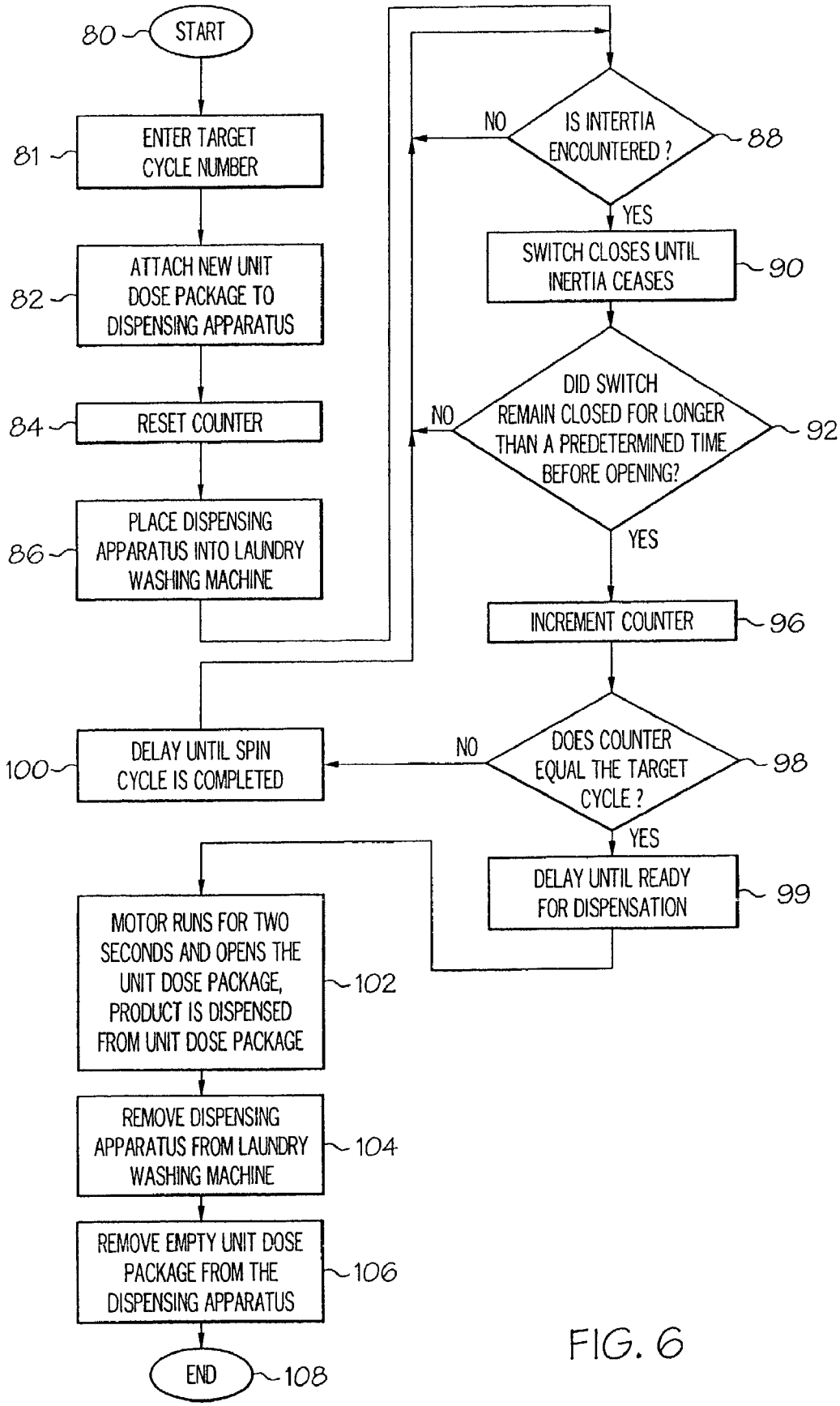
FIG. 6 is a flow chart depicting one exemplary method of operation of a dispensing apparatus of the present invention.

A dispensing apparatus of the present invention, such as that depicted in FIGS. 1–3 for example, can operate in accordance with the exemplary flowchart as depicted by FIG. 6. In that illustrated example, it is desired that fabric softener be released during the last rinse cycle of a laundry washing process involving a washing machine. The process starts (step 80) by acquiring dispensing apparatus 14 manufactured in accordance with the teachings of the present invention. If a target cycle number (e.g., the predetermined cycle of the laundering operation wherein one or more laundry additive materials are to be released by an actuator) is not already stored within dispensing apparatus 14, the user might provide the target cycle number to the dispensing apparatus by appropriately depressing a pushbutton, providing infrared data, otherwise entering data to the dispensing director or providing a bar code or another instructional characteristic of the unit dose package detectible by the dispensing apparatus (step 81). Upper shell 17 can separate from or open relative to lower shell 15 and a new unit dose package 21 can be inserted (step 82) into upper shell 17. Upper shell 17 can then be closed against lower shell 15. A counter within dispensing director 74 may then be reset (at 84), for example, automatically upon closure of an electrical switch which can occur when upper shell 17 closes with lower shell 15. That reset might alternatively be implemented manually by the user by way of a reset button or switch. Still alternately, a timer within dispensing director 74 can reset the counter automatically after a certain period of inactivity at sensors 59–60.

Dispensing apparatus 14 can then be placed into the washing machine (step 86) by a consumer, after which the operation of the laundry washing machine may be initiated. Sensors 59–60 in lower shell 15 of dispensing apparatus 14 detect (at 88) when high levels of inertia are encountered by dispensing apparatus 14. In other words, as discussed above, when dispensing apparatus 14 is bumped, spun rapidly, or otherwise subject to high amounts of inertia, first sensor 59 and/or second sensor 60 send one or more signals to the dispensing director 74. The signal(s) generated by sensors 59–60 can endure until the high-inertia event ceases (step 90). Dispensing director 74 then measures the total substantially continuous time that one or both sensors remain closed (step 92). If the total time is less than a predetermined time (e.g., about ten or twenty seconds for an exemplary washing machine application, or alternatively, a time sufficient to distinguish a full spin cycle from any other cycle), dispensing director 74 might then take no further action except to continue monitoring sensors 59–60 for additional high-inertia events (88). If the switch remains closed for a period exceeding the predetermined time, dispensing director 74 then increments its counter by one (step 96). Dispensing director 74 can then compare the counter's value to a predetermined value (step 98), wherein the predetermined value can be set by the program within the dispensing director. The predetermined value, for example, can be set to equal the total number of full spin cycles to be implemented by the washing machine upon a load of laundry before the last rinse cycle begins. If the counter does not equal the target cycle number, dispensing director 74 can implement a delay (step 100) before again monitoring for additional spin cycles (at step 88). This delay can be selected to ensure that one cycle (e.g., the most recently detected spin cycle) has ended or has sufficiently progressed before the dispensing director begins monitoring for another cycle (e.g., the next spin cycle). Accordingly, the delay can prevent the dispensing director from counting a single cycle multiple times. Hence, in one embodiment, the delay might last for the presumed remaining duration of the current spin cycle (e.g., about five minutes), or perhaps longer.

If the counter equals the target cycle number (e.g., the target spin cycle has been detected), dispensing director 74 might delay for a predetermined period (step 99). This predetermined period can extend, for example, until the last rinse cycle begins (e.g., until the current spin cycle is finished or perhaps until fresh water is thereafter introduced into the drum). For an exemplary washing machine application, this delay might equal about two minutes. After the delay at step 99, dispensing director 74 then activates amplifier 76 which applies power from power supply 68 to actuator 56 in order to cause actuator 56 to operate until the membrane is opened (e.g., for about two seconds for the exemplary washing machine example) (step 102), thereby opening membrane 27 of unit dose package 21. When membrane 27 of unit dose package 21 is opened by operation of actuator 56, the laundry additive materials contained within the one or more opened cavity of unit dose package 21 may flow into the drum (e.g., through one or more vent 25) (step 102). After dispensing laundry additive materials, the operational cycle eventually ends and dispensing apparatus 14 can be removed from the laundry washing machine (step 104). Upper shell 17 can then be separated from or opened relative to lower shell 15 and the empty unit dose package 21 can be removed (step 106) from dispensing apparatus 14 thereby completing (at 108) the process. The timing implemented in certain of the above steps by dispensing director 74 can be different for each application of the dispensing apparatus and may depend upon, for example, the duration of each cycle, the time expended between cycles, other aspects of the laundry washing machine, and the configuration of the actuator.

A dispensing apparatus as herein described can also be provided to consumers as part of a kit or a system, wherein such a kit or system might also include one or more varieties of unit dose packages. As mentioned above, it is to be understood that the dispensing director can additionally or alternatively be configured to identify and/or distinguish between any one or more of the operational cycles of, for example, a washing machine, including but not limited one or more wash, rinse and/or spin cycles. Furthermore, a dispensing apparatus can be configured to dispense virtually any combination of products from virtually any combination of cavities in virtually any sequence during the operation of the washing machine or other apparatus. For example, an exemplary dispensing apparatus for use in washing machines might be provided with a unit dose package having five cavities or chambers, wherein the first cavity containing detergent can be pierced by a spike upon closure of the top and bottom shells of the dispensing apparatus. The second cavity may then be opened by an actuator during the first wash cycle so as to release bleach into the drum. The third cavity might then be opened by the actuator when the first rinse cycle is started so as to release a further additive, such as a stain removal agent. During the last rinse cycle, the actuator can open the fourth and fifth cavities thereby releasing a fabric softener and a fragrance, respectively. In a similar manner, a dispensing apparatus of the present invention can be configured to dispense virtually any combination of (e.g., laundry additive) materials in virtually any sequence.

Although the foregoing description relates primarily to placement of the dispensing apparatus within the drum of a laundry washing machine, such as a residential or commercial front-loading or top-loading washing machine, it should be understood that the dispensing apparatus can also effectively function in other environments, including, for example, dishwashing machines or clothes dryers. Of course, in such other environments, the specific nature of the sensors and the parameters being sensed will vary. Likewise, the types of products dispensed and the dispensation algorithms can also vary substantially from those described above with respect to the use of the dispensing apparatus within a laundry washing machine.

The foregoing description of exemplary embodiments and examples of the invention has been presented for purposes of illustration and description. It is not intended to be exhaustive or to limit the invention to the forms described. Numerous modifications are possible in light of the above teachings. Some of those modifications have been discussed, and others will be understood by those skilled in the art. The embodiments were chosen and described in order to best illustrate the principles of the invention and various embodiments as are suited the particular use contemplated. It is hereby intended that the scope of the invention be defined by the claims appended hereto.

We claim:

1. A dispensing apparatus for use with a replaceable unit dose package having at least one cavity sealed by a membrane, the at least one cavity containing additive materials to be dispensed and said dispensing apparatus for use in a machine, the machine having a plurality of cycles, said dispensing apparatus comprising:

a dispensing director comprising a dispensing signal generator and a monitor for distinguishing among a plurality of machine operating cycles;

at least one sensor associated with the dispensing director and comprising a switch for detecting inertia, wherein the switch comprises a coiled spring having a free end at least partially surrounding a post displaced within the spring along the spring's longitudinal axis; and an actuator in communication with said dispensing director and configured to electromechanically open the membrane in response to a dispensing signal, thereby releasing additive materials from said at least one cavity.

2. The dispensing apparatus of claim 1 wherein the at least one sensor comprises two switches oriented effectively perpendicularly to one another.

3. A dispensing apparatus for use with a replaceable unit dose package having at least one cavity sealed by a membrane, the at least one cavity containing additive materials to be dispensed and said dispensing apparatus for use in a machine, the machine having a plurality of cycles, said dispensing apparatus comprising:

a dispensing director comprising a dispensing signal generator and a monitor for distinguishing among a plurality of machine operating cycles;

at least one sensor associated wit the dispensing director, wherein the at least one sensor comprises two switches oriented effectively perpendicularly to one another; and an actuator in communication with said dispensing director and configured to electromechanically open the membrane in response to a dispensing signal, thereby releasing additive materials from said at least one cavity.

4. A dispensing apparatus for use with a replaceable unit dose package having at least one cavity sealed by a membrane, the at least one cavity containing additive materials to be dispensed and said dispensing apparatus for use in a machine, the machine having a plurality of cycles, said dispensing apparatus comprising:

a dispensing director comprising a dispensing signal generator and a monitor for distinguishing among a plurality of machine operating cycles;

at least one sensor associated wit the dispensing director, wherein the at least one sensor comprises a switch for detecting inertia; and an actuator in communication with said dispensing director and configured to electromechanically open the membrane in response to a dispensing signal from the dispensing director, thereby releasing additive materials from said at least one cavity.

5. A dispensing apparatus for use with a replaceable unit dose package having at least one cavity sealed by a membrane, the at least one cavity containing additive materials to be dispensed and said dispensing apparatus for use in a machine, the machine having a plurality of cycles, said dispensing apparatus comprising:

a dispensing director comprising a processor, a dispensing signal generator, and a monitor for distinguishing among a plurality of machine operating cycles;

at least one sensor associated with the dispensing director, wherein the at least one sensor comprises a switch; and an actuator in communication with said dispensing director and configured to electromechanically open the membrane in response to a dispensing signal from the dispensing director, thereby releasing additive materials from said at least one cavity;

wherein the processor is configured by programming to identify spin cycles based upon signals received from the at least one sensor.

* * * * *